US009500349B2

(12) United States Patent
Radermacher

(10) Patent No.: US 9,500,349 B2
(45) Date of Patent: Nov. 22, 2016

(54) LIGHTING DEVICE AND METHOD FOR THE FLEXIBLE GENERATION AND DISTRIBUTION OF LIGHT

(71) Applicant: KONINKLIJKE PHILIPS N.V., Eindhoven (NL)

(72) Inventor: Harald Josef Günther Radermacher, Aachen (DE)

(73) Assignee: KONINKLIJKE PHILIPS ELECTRONICS N.V., Eindhoven (NL)

( * ) Notice: Subject to any disclaimer, the term of this patent is extended or adjusted under 35 U.S.C. 154(b) by 47 days.

(21) Appl. No.: 14/364,446

(22) PCT Filed: Dec. 7, 2012

(86) PCT No.: PCT/IB2012/057053
§ 371 (c)(1),
(2) Date: Jun. 11, 2014

(87) PCT Pub. No.: WO2013/088317
PCT Pub. Date: Jun. 20, 2013

(65) Prior Publication Data

US 2014/0313720 A1 Oct. 23, 2014

Related U.S. Application Data

(60) Provisional application No. 61/569,340, filed on Dec. 12, 2011.

(51) Int. Cl.

| | |
|---|---|
| ***F21V 23/00*** | (2015.01) |
| ***F21S 10/00*** | (2006.01) |
| ***H05B 33/08*** | (2006.01) |
| *F21V 14/02* | (2006.01) |
| *F21Y 101/02* | (2006.01) |

(52) U.S. Cl.
CPC ..... *F21V 23/00* (2013.01); *F21S 10/002* (2013.01); *H05B 33/086* (2013.01); *H05B 33/0815* (2013.01); *F21V 14/02* (2013.01); *F21Y 2101/02* (2013.01)

(58) Field of Classification Search
CPC . F21V 23/00; H05B 33/0815; H05B 33/086; F21S 10/002
See application file for complete search history.

(56) References Cited

U.S. PATENT DOCUMENTS

| | | | |
|---|---|---|---|
| 2003/0063460 | A1 | 4/2003 | Nadel |
| 2004/0022058 | A1 | 2/2004 | Birrell |
| 2008/0303445 | A1 | 12/2008 | Neuman et al. |
| 2011/0175533 | A1 | 7/2011 | Holman et al. |

FOREIGN PATENT DOCUMENTS

| | | | |
|---|---|---|---|
| CN | 101356402 | A | 1/2009 |
| FR | 2528656 | A1 | 12/1983 |
| WO | 2012120404 | A1 | 9/2012 |
| WO | 2013024420 | A1 | 2/2013 |

*Primary Examiner* — Joseph L Williams

(57) ABSTRACT

The invention relates to a method and a lighting device for generating light. The lighting device has at least one light source connected to two receiving-electrodes, at least two supply-electrodes for generating an electrical field, wherein the relative configuration between the receiving-electrodes and the electrical field can change. Such a change may, for example, come about by a movement of the receiving-electrodes relative to the electrical field and/or by changing the configuration of the electrical field. The light source and/or the receiving-electrodes may be embedded in a non-solid filling of a container. Thus three-dimensional structures of light sources can be designed in which the light sources may optionally be movable.

15 Claims, 5 Drawing Sheets

LIGHTING DEVICE AND METHOD FOR THE FLEXIBLE GENERATION AND DISTRIBUTION OF LIGHT

CROSS-REFERENCE TO PRIOR APPLICATIONS

This application is the U.S. National Phase application under 35 U.S.C. §371 of International Application No. PCT/IB2012/057053, filed on Dec. 07, 2012, which claims the benefit of [e.g., U.S. Provisional Patent Application No. or European Patent Application No.] 61/569,340, filed on Dec. 12, 2011. These applications are hereby incorporated by reference herein.

FIELD OF THE INVENTION

The invention relates to a lighting device comprising at least one light source, for example an LED, and a method for generating light.

BACKGROUND OF THE INVENTION

The US 2003/063460 A1 discloses a lighting device comprising a liquid container in which at least one light chip is free to move. The light chip comprises a light source and a battery for powering it.

SUMMARY OF THE INVENTION

It is an object of the invention to provide means that allow for a flexible generation of light, particularly a flexible distribution of light sources in three dimensions.

This object is achieved by a lighting device according to claim 1 and a method according to claim 2. Preferred embodiments are disclosed in the dependent claims.

According to its first aspect, the invention relates to a lighting device comprising the following components:

a) At least one light source, i.e. a light generating and emitting element, and at least two electrodes which are connected to said light source. For purposes of reference, these electrodes will in the following be called "receiving-electrodes" because they are intended for the reception of electrical power. The system of light source and receiving-electrodes will in the following sometimes be called "light unit". The shape and relative arrangement of the receiving-electrodes may be quite arbitrary. Typically, each receiving-electrode will have a two-dimensional extension in some area, wherein said areas of the two receiving-electrodes are preferably parallel to each other. Moreover, the light source and the receiving-electrodes will typically be rigidly connected, though in general these components may be movable with respect to each other.

b) At least two electrodes for generating an electrical field, wherein said electrodes will in the following be called "supply-electrodes" indicating that they are intended for supplying electrical energy (capacitively via the electrical field) to the receiving-electrodes. The shape and relative arrangement of the supply-electrodes is quite arbitrary. Typically, it is such that the receiving-electrodes can be positioned in the space between the supply-electrodes (without requiring a direct electrical contact to the supply-electrodes).

Moreover, the lighting device has the feature that the relative configuration of the receiving-electrodes and the electrical field generated by the supply-electrodes can change during the operation of the lighting device.

In this context, the "relative configuration" refers to the geometry of the receiving-electrodes and the electrical field (i.e. the field lines); a mere increase or decrease in magnitude of the electrical field would hence not count as a configurational change.

The change in the relative configuration may come about selectively, i.e. under control of a user or an automatic control device, or it may be caused by random variations of e.g. the relative position between receiving-electrodes and supply-electrodes. Most preferably, the change in the relative configuration is accompanied by a noticeable change in the electrical coupling of the receiving-electrodes to the electrical field, i.e. the amount of energy captured by the receiving-electrodes may vary, resulting in a perceptible change of the intensity of the light source. The energy captured by the receiving-electrodes may thus for example vary between a maximum (M) and 80% of this maximum (i.e. 0.8·M), preferably between the maximum and 30% thereof (0.3·M), most preferably between the maximum and approximately zero.

According to a second aspect, the invention relates to a method for generating light, wherein this generation of light may particularly be achieved with a lighting device of the kind described above. The method comprises the following steps, which may be executed in the listed or any other appropriate order:

a) Generating an electrical field, for example by supplying a (AC) voltage to at least two supply-electrodes of the kind described above.

b) Coupling at least two receiving-electrodes capacitively to the aforementioned electrical field and powering a light source with the energy received by the receiving-electrodes due to this coupling.

c) Changing the relative configuration between the receiving-electrodes and the electrical field.

The lighting device and the method defined above are based on the same inventive concept, i.e. that energy is transferred to a light source via an electrical field and receiving-electrodes, wherein the relative configuration between said field and electrodes can be changed. Explanations and definitions provided for the lighting device are therefore also valid for the method and vice versa. Moreover, the preferred embodiments of the invention that are described below may be realized with the lighting device as well as with the method.

The lighting device and the method have the advantage that power is supplied to light sources via an electrical field in a very flexible way. Moreover, this transfer of power can readily be modulated (actively or passively) by changing the relative configuration between receiving-electrodes and electrical field. Hence no elaborate wiring or control circuitry of the light sources is necessary, which allows particularly for a flexible three-dimensional distribution of light sources and/or movable light sources.

According to a first preferred embodiment of the invention, the electrical field is generated with varying geometry (of the field lines).

This may for example be achieved by providing at least three supply-electrodes and a controller for supplying said three supply-electrodes with voltages of varying magnitudes. The controller may particularly be adapted to provide the three supply-electrodes with voltages of varying relative ratios. For example, the three supply-electrodes may first be supplied with the voltages V1, V2, and V3, respectively, and later with the voltages V1', V2', and V3', wherein at least one of the ratios (V1:V2), (V1:V3), (V2:V3) is different from the corresponding ratios (V1':V2'), (V1':V3'), (V2':V3'). Varying the voltages in this way implies that the electrical field that is generated between the supply-electrodes has a varying geometry of the field lines. Accordingly, the configuration between this electrical field and receiving-electrodes that are stationarily positioned between the supply-electrodes will change due to the changing geometry of the electrical field. In general, changing the configuration of the electrical field with respect to a stationary arrangement of receiving-electrodes is one way to control the energy supply to the light sources.

It should be noted that the aforementioned embodiment shall also comprise the case in which one or more of the supply-electrodes are temporarily not connected to a voltage (i.e. floating) or connected to ground (zero voltage).

According to another embodiment of the invention, at least one receiving-electrode and/or at least one light source is movable with respect to the electrical field and/or with respect to the supply-electrodes (if stationary voltages are applied to the supply-electrodes, the electrical field will not change and mobility with respect to the electrical field is usually tantamount to mobility with respect to the supply-electrodes). Moving the receiving-electrodes with respect to the supply-electrodes is another way to change the relative configuration or the transfer of electrical power to the light source. This can of course be combined with the aforementioned possibility, i.e. the generation of an electrical field of varying geometry.

In a further development of the aforementioned embodiment, the lighting device comprises a steering unit for inducing, supporting, and/or affecting a movement of the movable receiving-electrode and/or the movable light source. The steering unit might for example comprise an electromotor or an actuator for actively generating a movement.

An active steering unit may particularly be powered by heat, for example excess heat that is generated anyway by the operation of the light source or any other component in the lighting device or light unit. Heat may for example be used to alter the specific gravity of the light unit. For example, a fluid or an air bubble within the light unit may expand during warming and hence reduce the specific gravity of the light unit. Then, assuming a suitable non-solid filling around the light unit, the light unit may rise and hence alter its position with respect to the field of the supply electrodes.

Additionally or alternatively, the steering unit may comprise a particular design of the light unit. The body of the light source or a receiving electrode may for example be shaped in a special way (bended, curved etc.), such that during rising up or sinking down, the light source rotates about at least one axis. This is a further method to change the position of the receiving-electrodes with respect to the supply electrodes, providing stronger influence on the amount of light from a specific light source. Alternatively, heat generated by some losses in the light source may stimulate a convention in the vicinity of the light unit, which (after interaction with the shape of the body of the light source or the receiving electrodes) actuates a movement of the light unit.

According to another preferred embodiment of the invention, a container may be provided that comprises a non-solid filling, wherein said filling embeds the light source and/or the receiving-electrodes. Thus it is possible to realize the aforementioned embodiment in which the receiving-electrodes are movable. The non-solid filling may for example be a fluid or a gel.

According to a further development of the aforementioned embodiment, the filling has a relative permittivity ($\epsilon_r$) that is larger than about 1, preferably lager than about 2, most preferably larger than about 5. Thus it is guaranteed that the electrical field can well couple through the filling to the receiving-electrodes.

As an add-on, the light unit (i.e. the light source and its associated receiving-electrodes) may comprise at least one additional (third) receiving-electrode for receiving a signal from the electrical field by which the light output of the light source is controlled. Said additional receiving-electrode may particularly have a different spatial orientation than the other receiving-electrodes of the light unit. The signal received via this additional receiving-electrode with respect to any of the other receiving-electrodes may for example be added or subtracted to the driving current for the light source (e.g. an LED), or may in any other way influence the brightness of the light, the color or the light, the direction of the light, and so on. This enables having a higher degree of freedom, by a more detailed linking of the generated light to the total field (in multiple directions) at the position and orientation of the light unit.

A preferred embodiment with the aforementioned additional receiving-electrode is achieved when at least one light source in at least one light unit is an LED. Using e.g. a conventional LED, power has to be fed to the two electrodes (e.g. anode and cathode) of the LED. The powering, i.e. the current driven through the two electrodes, may depend on or even be equivalent (except for the polarity) to the current of the two associated receiving-electrodes. Alternatively to this, an additional (i.e. third) receiving-electrode may be coupled to the powering unit for the LED, such that a current in the additional receiving-electrode is added to or subtracted from the current in the LED. A passive implementation for adding a current may for example use a rectifier with three inputs (like a known three phase bridge rectifier). In order to increase the controllability, additional elements for limiting the current may be coupled to the connection from the additional receiving-electrode to the rectifier. These elements may have a frequency dependant limiting effect, such that any signal via the two original receiving-electrodes is given to the LED with no or only low damping, while signals via the additional receiving-electrode have the largest effect when they are in a certain frequency range.

Additionally or alternatively to the aforementioned passive embodiments, the additional receiving-electrode may optionally have another operational effect on the light source than the other receiving-electrodes. It may, for example, provide an input to a control unit that controls the power supply from the other receiving-electrodes to the light source.

Optionally, the receiving-electrodes may at least partially be insulated on their outer surface. This is for example favorable in the above-mentioned embodiment of movable receiving-electrodes, because an electrical short between the receiving-electrodes and other components can thus be prevented.

The materials that are arranged around the light source are preferably (at least partially) transparent to allow for the unimpeded emission of the generated light. In particular, the receiving-electrodes, the supply-electrodes, and/or the above-mentioned container and/or its filling may at least partially be transparent.

The light source may in general be realized by any appropriate technology. Preferably, the light source comprises a Light Emitting Diode (LED) which is favorable inter alia in terms of low power consumption and heat generation.

According to another preferred embodiment, a rectifying circuit is provided between the receiving-electrodes and the associated light source. Thus alternating voltages captured by the receiving-electrodes can be converted into direct voltages (or currents), which are for example needed to drive an LED.

The light source may preferably be embedded in a transparent (solid) encapsulation material. Thus the light source and associated electrical components can be shielded, mechanical stability can be provided, and the light source can be connected to the receiving-electrodes. Optionally, the encapsulation material may provide for a color conversion of the light generated by light source.

At least one of the supply-electrodes may be composed of a mesh or grid. Thus an electrical field emanating from a comparatively large area may be realized while the supply-electrode remains (at least partially) transparent.

An efficient power transfer from the supply-electrodes to the receiving-electrodes may be achieved with an electrical field that is time-variable (in its magnitude and/or geometry). Such an electrical field may for example be generated if the supply-electrodes are supplied with an AC voltage. The frequency of this AC voltage may be chosen comparatively large, for example as 0.5 MHz or larger.

BRIEF DESCRIPTION OF THE DRAWINGS

These and other aspects of the invention will be apparent from and elucidated with reference to the embodiments described hereinafter.

In the drawings.

Like reference numbers or numbers differing by integer multiples of 100 refer in the Figures to identical or similar components.

DETAILED DESCRIPTION OF EMBODIMENTS

LED based light sources, both for general illumination as well as for decorative purposes, are gaining importance because LEDs offer efficiency and a high level of flexibility. Normally, the driving and wiring effort for light sources scales with the degree of flexibility. Especially when motion or 3D lamp arrangements are involved, the flexibility is often limited by practical aspects due to wiring or controlling the multiple degrees of freedom. It would therefore be desirable to have a 3D lighting object that is not limited by any wiring issues.

The present invention addresses the aforementioned issues by providing a capacitive powering of LED light sources. In an embodiment, a space or cavity (preferably with transparent walls) is filled with a material (preferably a gel or liquid, like oil or water) with a certain permittivity. Light units are embedded in this material, these light units consisting of "receiving-electrodes" and at least one LED. The cavity is also equipped with "supply-electrodes" for generating an electric field in the cavity. Using multiple (pairs of) supply-electrodes, different areas in the cavity can be excited and the direction of the electric field can be influenced, too. The light sources in this area may pick up the electric field and light up. If a light source finally emits light depends on the position of the light source, but also in the orientation of the associated receiving-electrodes with respect to the direction of the electrical field. Multiple light sources positioned very closely together but with different orientation can selectively be addressed by the direction of the electrical field. The lighting device hence offers a high degree of flexibility and freedom in positioning and orienting the light sources.

Figure 1:
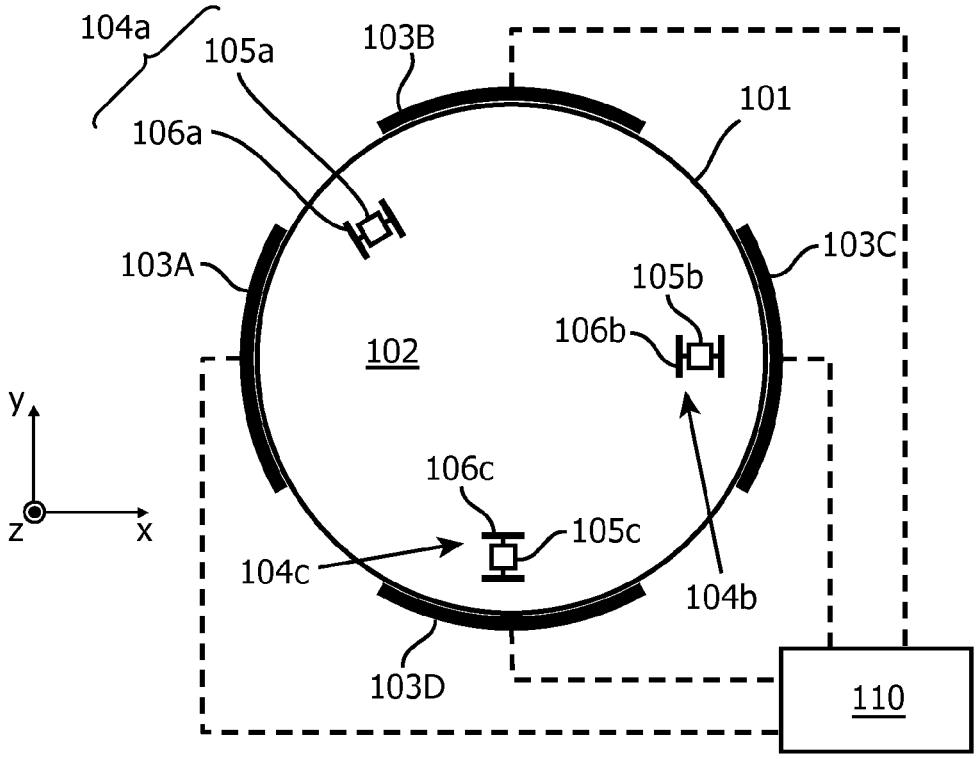
FIG. 1 schematically shows a top view onto a lighting device according to a first embodiment of the invention comprising three light sources and four supply-electrodes.

FIG. 1 shows a schematic top view onto a lighting device 100 according to a first embodiment of the invention. The lighting device 100 comprises the following components:

- A casing or container 101 comprising a filling 102, for example a liquid or gel.
- Four supply-electrodes 103A, 103B, 103C, 103D that are distributed along the exterior wall of the container 101 and that are separately connected to a controller 110 by which voltages can selectively be applied to each of them. Alternatively, all or some of the supply electrodes may be at the inner side of the wall of the container 101.
- Three light units 104*a*, 104*b*, and 104*c*. Each light unit comprises a light source 105*a*, 105*b*, 105*c* with associated receiving-electrodes 106*a*, 106*b*, and 106*c*, respectively. The light units are embedded in the filling 102, where they may be fixed at some given location or be floating.

Figure 2:
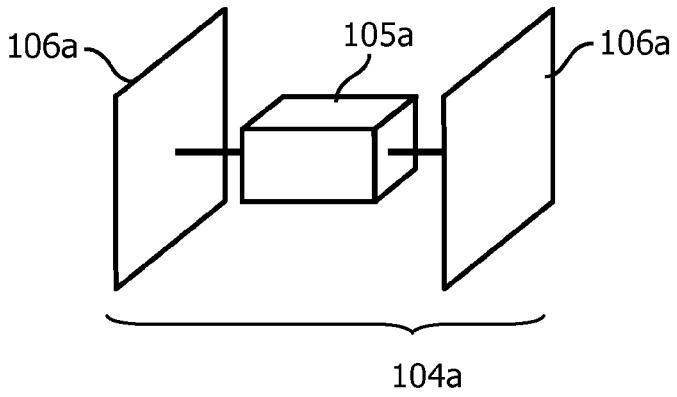
FIG. 2 shows in a perspective view a light unit of the lighting device of FIG. 1.

FIG. 2 shows exemplarily one of the light units 104*a* with a light source 105*a* and associated receiving-electrodes 106*a* in a perspective view. It can be seen that the light source 105*a* is connected by electrical leads to two planar receiving-electrodes 106*a* that are arranged parallel to each other on opposite sides of the light source 105*a*. The receiving-electrodes 106*a* provide a sufficiently large area for a capacitive coupling to the supply-electrodes.

Preferably the supply-electrodes 106*a* are transparent to avoid blocking of the light emission from the LED 105*a*. Alternatively, the electrodes may have a high reflectivity, at least for the wavelength spectrum of the light emitted by the light source, e.g. a white surface or a mirror, in especially at these sides that are facing towards the light source. Furthermore, the supply-electrodes 106*a* may be covered with an electrically non-conductive layer on the outer side, in order to prevent any short-circuiting with neighboring light units. This is particularly important if a light unit is movable.

The space between the supply-electrodes 106*a* may be filled with an encapsulation material (not shown) with a different (e.g. lower) permittivity than the surrounding. This material may also interact with the light from the LED 105*a* (e.g. diffuse the light, convert its color etc.).

Figure 3:
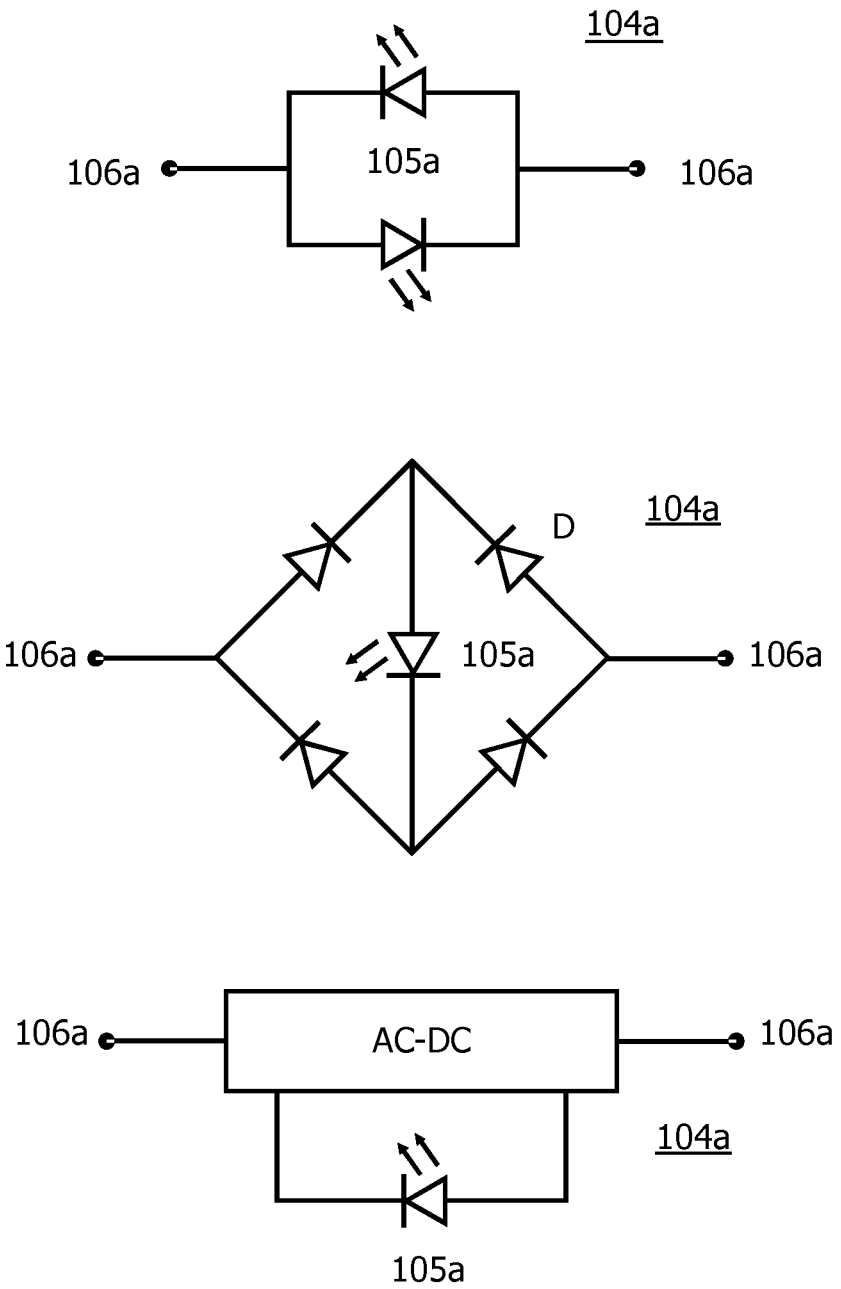
FIG. 3 illustrates three possible circuits for connecting the receiving-electrodes and the light source.

FIG. 3 shows three possibilities how LED light sources 105*a* can electrically be connected to receiving-electrodes 106*a* such that an alternating voltage captured by the receiving-electrodes can be used. In the first embodiment (top drawing), two LEDs 105*a* are connected in parallel but with different polarities between the receiving-electrodes 106*a*.

In the second embodiment (middle drawing), an LED 105*a* is connected to the receiving-electrodes 106*a* via a rectifier circuit that is realized by four diodes D.

In the last embodiment (bottom drawing), the LED 105*a* is connected to a general AC/DC converter.

Alternatively, an unipolar LED may be used and some bypass for the opposite polarity may be provided.

Figure 4:
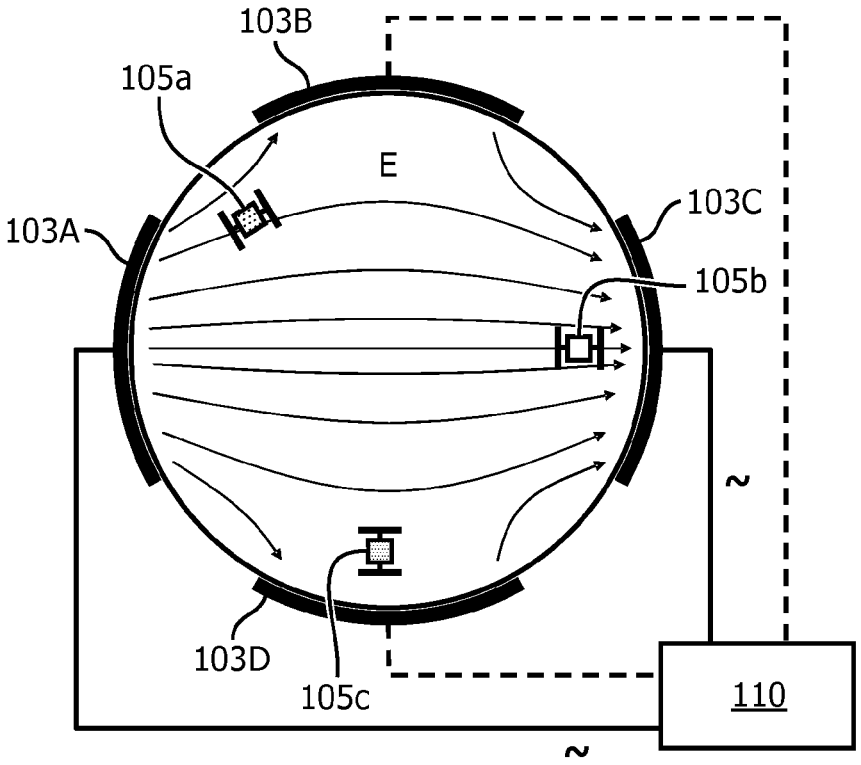
FIG. 4 illustrates the lighting device of FIG. 1 when voltages are applied to a first set of two opposite supply-electrodes.

FIG. 4 shows the lighting device 100 of FIG. 1 when a voltage is applied by the controller 110 (only) to a first set of two opposite supply-electrodes 103A and 103C. Accordingly, an electrical field E is generated between these electrodes.

Powering of the light sources then occurs via capacitive coupling. Hence, the excitation voltage (or field E) should be AC with a relative high frequency (e.g. over 1 MHz). Pick up of the electric field E takes place via the receiving-electrodes 106*a*, 106*b*, 106*c*.

The filling 102 of the cavity inside the container 101 preferably has a high permittivity. This material will help to couple the receiving-electrodes 106*a*, 106*b*, 106*c* of the light sources 105*a*, 105*b*, 105*c* with the supply-electrodes 103A, 103B, 103C, 103D on the outer side of the cavity.

Figure 5:
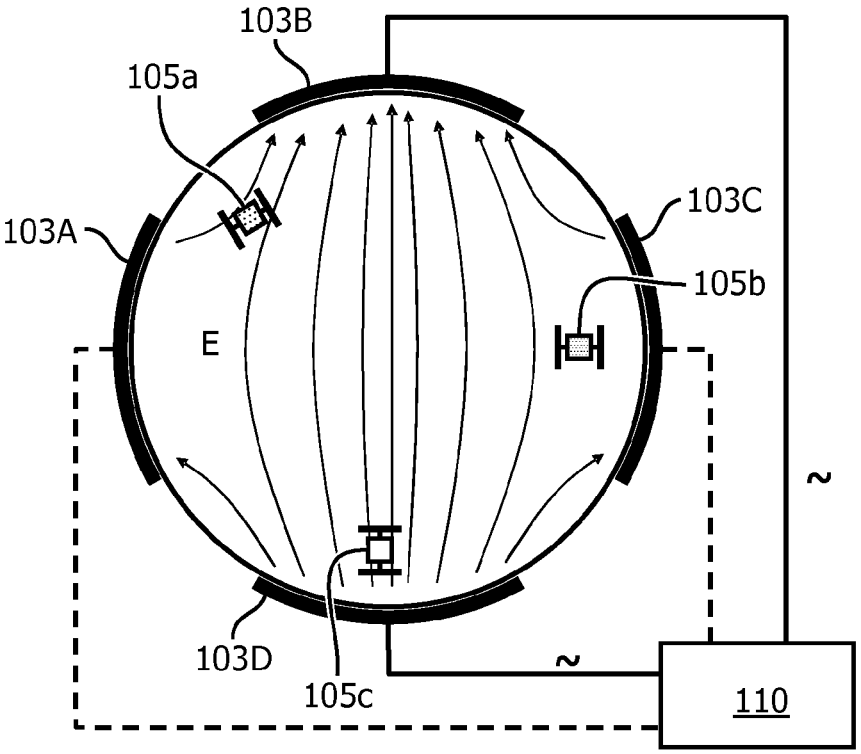
FIG. 5 illustrates the lighting device of FIG. 1 when voltages are applied to a second set of two opposite supply-electrodes.
Figure 6:
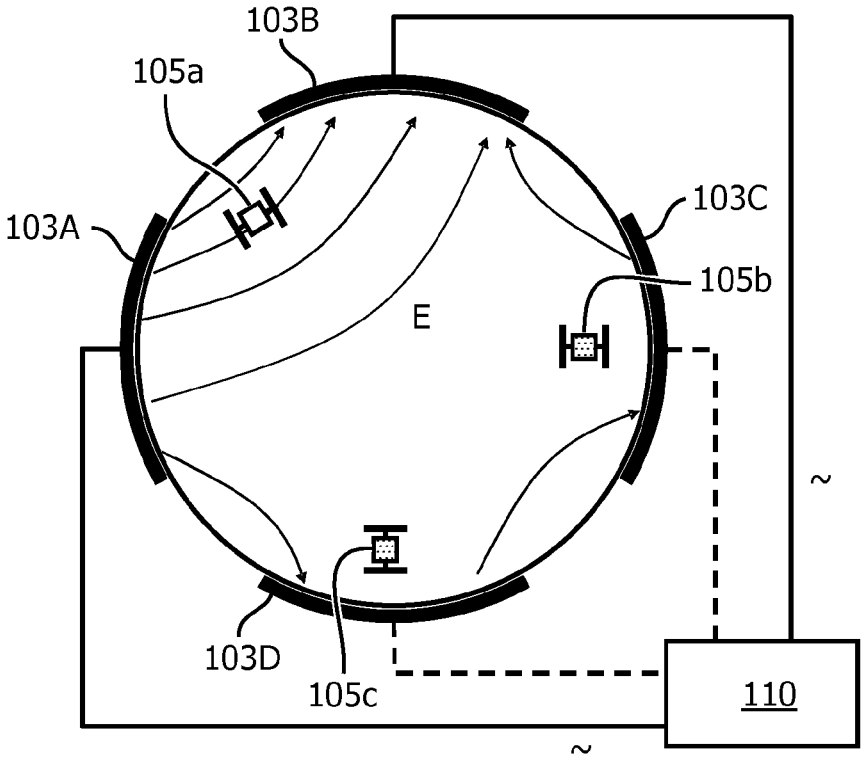
FIG. 6 illustrates the lighting device of FIG. 1 when voltages are applied to a set of neighboring supply-electrodes.

Inside the cavity, an alternating electric field E is created. The direction and strength of this field E depends on the geometry of the supply-electrodes and the supplied voltage. The (conductive) receiving-electrodes will influence the field, too. In FIGS. 4-6, the effect of the receiving-electrodes is neglected.

According to FIG. 4, the light sources 105*a*, 105*b*, 105*c* are placed at different positions and with different orientations (here, only rotation about the z-axis is used) and exposed to the electric field E. In this configuration, LED 105*a* would receive some energy, LED 105*b* is fully powered, and LED 105*c* is off.

In FIG. 5, a different set of opposite supply-electrodes 103B and 103D is supplied by controller 110 with a voltage. Now LED 105*a* receives some energy, LED 105*c* is fully powered, and LED 105*b* is off.

In FIG. 6, two neighboring supply-electrodes 103A and 103B are supplied by controller 110 with a voltage. Now only LED 105*a* is fully powered while LEDs 105*b* and 105*c* are off. The examples show that the energy transfer to each light source can be varied between a maximum (fully powered) and zero (off).

Figure 7:
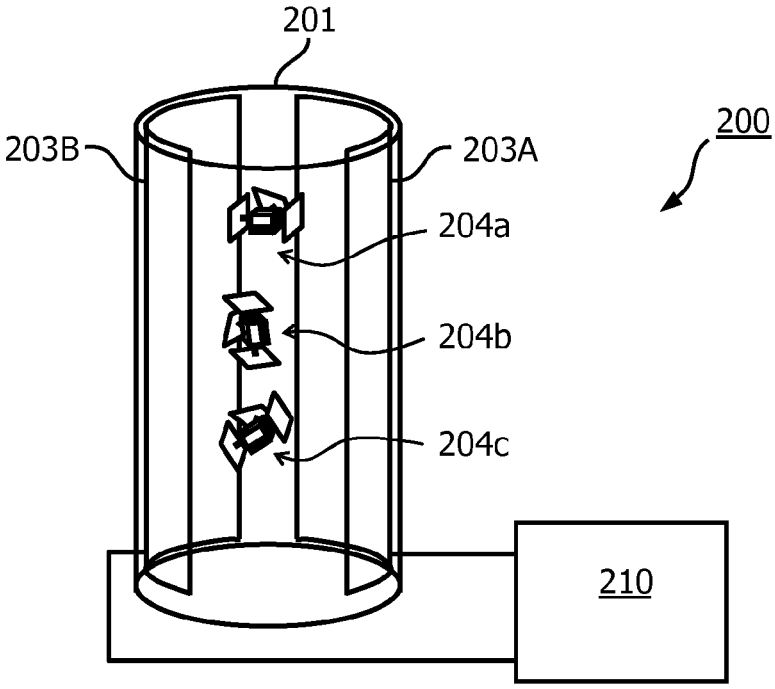
FIG. 7 schematically shows a perspective view of a second lighting device according to the present invention.

FIG. 7 shows another embodiment of a lighting device 200 comprising a cylindrical container 201 with two supply-electrodes 203A, 203B at opposite sides that are connected to a controller 210. Three light units 204*a*, 204*b*, 204*c* with associated light sources and receiving-electrodes that are differently oriented are also shown within the container. The supply-electrodes on the sides of the cavity should be highly conductive and preferably be transparent. Alternatively, transparent material and a grid (mesh) of conductors may be used to realize them, too.

Figure 8:
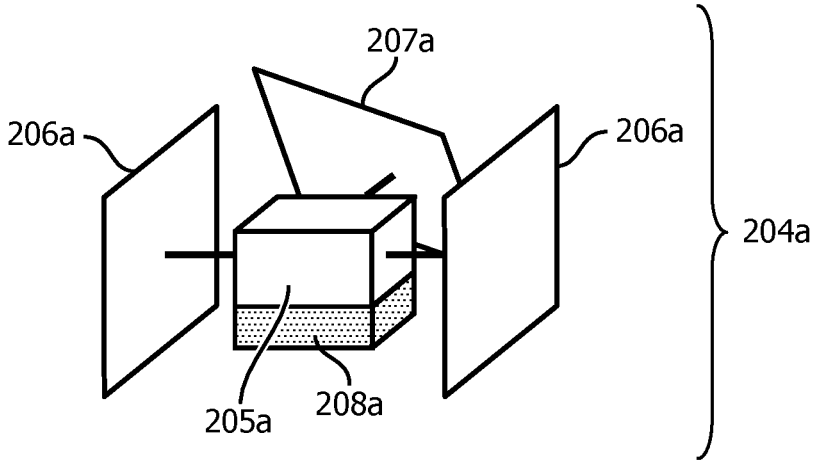
FIG. 8 shows in a perspective view a light unit of the lighting device of FIG. 7, said light unit having three receiving-electrodes.
Figure 9:
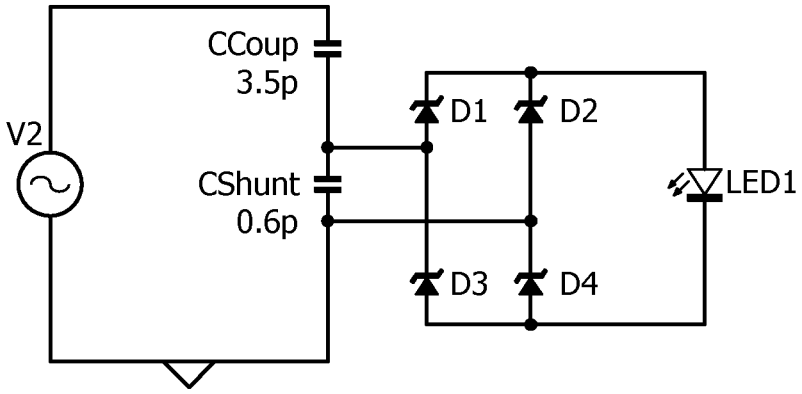
FIG. 9 shows an equivalent circuit diagram for calculations of the capacitive coupling.

FIG. 8 shows exemplarily one of the aforementioned light units 204*a* in a perspective view. As in the case of FIG. 2, the light source 205*a* is connected by electrical leads to two planar receiving-electrodes 206*a* that are arranged parallel to each other on opposite sides of the light source 205*a* and that may provide the power to drive the light source. Moreover, the light unit comprises an additional receiving-electrode 207*a* for receiving a signal from an electrical field E by which the light output of the light source 205*a* can be controlled. The signal received via this additional receiving-electrode 207*a* with respect to any of the other receiving-electrodes may for example be added or subtracted to the driving current for an LED 205*a*. In the circuits of FIG. 3, the additional receiving-electrode (207*a*) might for example simply be added to the input node of one ("normal") receiving-electrode (106*a*). Preferably, a structure like in the lowest part of FIG. 3 is used, but using a ACDC converter with three inputs, in the simplest case a three phase full rectifier.

Moreover, a steering unit 208*a* can be seen that is intended for inducing a movement of the movable light unit 204*a*. The steering unit 208*a* may for example comprise an expandable container filled with a liquid or a gas that expands when heated e.g. by excess heat of the light source 205*a*. This changes the specific gravity of the light unit 204*a*, inducing its rising within the container 201 of the lighting device 200.

The coupling capacity $C_{coup}$ from the supply-electrodes to the light sources and the shunting capacity $C_{shunt}$ of the light sources were calculated for the equivalent circuit shown in FIG. 8. The fill of the light sources was set to $\epsilon_r$=1, while for the filling medium in the cavity $\epsilon_r$=80 was selected. With some exemplary geometry data (15 cm cavity diameter, 3 cm light source electrode diameter, 1 cm light source distance), the capacities where approximated to be $C_{coup}$=3.5 pF and $C_{shunt}$=0.6 pF.

Although these capacitances are low, it is possible to deliver substantial current to the LEDs by simply selecting a high frequency (e.g. 10 MHz) and a reasonable voltage (e.g. 70 V rms). The average LED current is 12 mA, which is sufficient to drive low power LEDs. Other geometrical or electrical arrangements will result in other currents.

The described embodiments of the invention used only up to four electrodes in the cavity. In general, the distribution and/or number of supply-electrodes, light sources, and receiving-electrodes may largely vary. For example with additional (e.g. top and bottom) electrodes, more degrees of freedom in position and orientation of the light sources can be used for addressing them. Also, structured or differently shaped receiving-electrodes may be used.

In summary, the invention proposes a 3D lighting object that is not limited by any wiring issues and minimizes control effort. A lighting device is provided that comprises at least one light source connected to at least one receiving-electrode. Moreover, it comprises at least two supply-electrodes for generating an electrical field, wherein the relative configuration between the receiving-electrode(s) and the electrical field can change. Such a change may for example come about by a movement of the receiving-electrodes relative to the electrical field and/or by changing the configuration of the electrical field. The light source and/or the receiving-electrodes are preferably embedded in a non-solid filling of a container. Thus three-dimensional structures of light sources can be designed in which the light sources may optionally be movable.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A lighting device comprising:

a) at least one light source that is connected to at least two receiving-electrodes;

b) at least two supply-electrodes for generating an electrical field;

wherein the at least one light source is connected to the at least two receiving-electrodes;

the light source with the at least two receiving-electrodes is positioned in the space between the at least two supply-electrodes; and the relative configuration of the receiving-electrodes and the electrical field is changeable.

2. A method for generating light, comprising the following steps:

a) generating an electrical field;

b) coupling at least two receiving-electrodes capacitively to said electrical field c) said at least two receiving-electrodes powering a light source with the received energy; and d) changing the relative configuration of the receiving-electrodes and the electrical field.

3. The method according to claim 2, wherein the electrical field is generated with varying geometry.

4. The lighting device according to claim 1, wherein the lighting device comprises at least three supply-electrodes and a controller for supplying voltages of varying magnitudes to said supply-electrodes.

5. The lighting device according to claim 1, wherein at least one receiving-electrode of the two receiving electrodes and/or the at least one light source is movable with respect to the electrical field and/or with respect to the supply-electrodes.

6. The lighting device according to claim 5, further comprising a steering unit for inducing, supporting, and/or affecting a movement of the movable receiving-electrode and/or light source, wherein the steering unit is preferably powered by heat.

7. The lighting device according to claim 1, further comprising a container with a non solid filling that embeds the receiving-electrodes and/or the light source.

8. The lighting device according to claim 1, further comprising at least one additional receiving electrode for receiving a signal from the electrical field by which the light output of the light source is controlled, wherein said additional receiving electrode has another spatial orientation than the other receiving-electrodes.

9. The lighting device according to claim 1, wherein the at least two receiving-electrodes are at least partially insulated.

10. The lighting device according to claim 7, wherein the receiving-electrodes, the supply-electrodes, the container, and/or the filling of the container are at least partially transparent.

11. The lighting device according to claim 1, wherein the light source comprises an LED.

12. The lighting device according to claim 1, wherein the receiving-electrodes and the light source are connected via a rectifying circuit.

13. The lighting device according to claim 1, wherein the light source is embedded in a transparent encapsulation material.

14. The lighting device according to claim 1, wherein the at least one supply-electrode is composed of a mesh.

15. The method according to claim 2, wherein the electrical field is generated by applying an AC voltage to supply-electrodes.

* * * * *